US007458641B2

(12) United States Patent
Wang

(10) Patent No.: US 7,458,641 B2
(45) Date of Patent: Dec. 2, 2008

(54) SINGLE FRAME SLING CHAIR

(75) Inventor: Oliver Wang, Kowloon (HK)

(73) Assignee: Agio International Company, Limited, Kowloon (HK)

( * ) Notice: Subject to any disclaimer, the term of this patent is extended or adjusted under 35 U.S.C. 154(b) by 0 days.

(21) Appl. No.: 11/193,779

(22) Filed: Jul. 29, 2005

(65) Prior Publication Data

US 2007/0024102 A1 Feb. 1, 2007

(51) Int. Cl.
*A47C 7/00* (2006.01)
*A47C 7/02* (2006.01)

(52) U.S. Cl. ..... 297/440.11; 297/452.13; 297/452.56

(58) Field of Classification Search ..... 297/452.13, 297/440.11, 452.56, 452.58, 452.59, 452.6, 297/452.62
See application file for complete search history.

(56) References Cited

U.S. PATENT DOCUMENTS

| | | | | | |
|---|---|---|---|---|---|
| 1,515,711 | A | * | 11/1924 | Van Hove | 5/402 |
| 2,275,908 | A | | 3/1942 | Kelly | |
| 2,512,353 | A | | 6/1950 | Magaldino et al. | |
| 2,786,513 | A | * | 3/1957 | Hoven et al. | 297/218.5 |
| 2,809,692 | A | | 10/1957 | Taffae | |
| 3,437,375 | A | * | 4/1969 | Kettler | 297/440.11 |
| 3,677,601 | A | | 7/1972 | Morrison et al. | |
| 3,856,353 | A | | 12/1974 | Morrison et al. | |
| 4,588,227 | A | | 5/1986 | Austin | |
| 5,338,091 | A | * | 8/1994 | Miller | 297/218.4 |
| 5,503,455 | A | * | 4/1996 | Yang | 297/377 |
| 5,655,812 | A | | 8/1997 | Albecker, III | |
| 5,678,890 | A | | 10/1997 | Tenbroeck | |
| 6,623,079 | B2 | * | 9/2003 | Gregory | 297/440.11 |
| 6,779,849 | B1 | * | 8/2004 | Harper et al. | 297/452.13 |
| 6,783,183 | B2 | | 8/2004 | Tseng | |
| 6,880,215 | B2 | | 4/2005 | Peterson | |
| 6,899,398 | B2 | | 5/2005 | Coffield | |
| 2003/0071509 | A1 | * | 4/2003 | Neil et al. | 297/440.11 |
| 2004/0262975 | A1 | * | 12/2004 | Su | 297/440.11 |
| 2005/0146193 | A1 | | 7/2005 | Shieh | |

* cited by examiner

*Primary Examiner*—Sarah B McPartlin
(74) *Attorney, Agent, or Firm*—Williams Mullen; M. Bruce Harper

(57) ABSTRACT

A sling chair includes a back frame member having side rails held in substantially parallel relation by a pair of cross bar members. In one embodiment, the cross bar members are generally curved so as to extend away from the back faces of the side rails, forming a concave back structure which can receive a sling member and, eventually, a seated occupant. The cross bar members are adapted to retain the sling member in secure fashion through upper and lower backrest assemblies, resulting in better support and more efficient assembly. This also facilitates separate provisioning of decorative features to improve the chair's aesthetic qualities.

8 Claims, 4 Drawing Sheets

SINGLE FRAME SLING CHAIR

FIELD OF THE INVENTION

The present invention relates to chair constructions, and more particularly relates to a chair construction employing a sling-type backrest which promotes chair stability, comfort and a variety of design alternatives.

BACKGROUND OF THE INVENTION

Various types of sling chairs have been known which provide a somewhat concave and/or giving backrest. Such chairs generally include a back portion and a seat portion, and may optionally include armrest portions. The back portion generally includes a back frame and a flexible yet supportive backrest made of fabric or other suitable material and mounted to the back frame. Different mechanisms have been employed for securing the backrest to the back frame, and these prior art mechanisms have suffered from several deficiencies. First, these prior art mechanisms often fail to provide a secure connection, which can result in the backrest being unsupportive of the seated individual. Further, the sling backrest for these chairs is frequently retained along the chair side rail supports, creating side-to-side sling tension, restricting the potential to add decorative chair features, and complicating assembly.

SUMMARY OF THE INVENTION

The present invention provides a connection assembly for a sling chair which allows for efficient chair assembly and results in a comfortable yet sturdy chair. The present invention includes a back frame member having side rails held in substantially parallel relation by a pair of cross bar members. In one embodiment, the cross bar members are generally curved so as to extend away from the back faces of the side rails, forming a concave back structure which can receive a sling member and, eventually, a seated occupant. The cross bar members are adapted to retain the sling member in secure fashion through upper and lower backrest assemblies. In this way, the sling member is not secured to the side rails, but rather to the cross bar members, resulting in better support, a more secure connection and more efficient assembly. The method of securing the sling member using a detachable support bar having a scaffold support element ensures that the sling member is efficiently and securely retained. The present invention also facilitates separate provisioning of decorative features to improve the chair's aesthetic qualities.

DETAILED DESCRIPTION OF THE PREFERRED EMBODIMENTS

Figure 1:
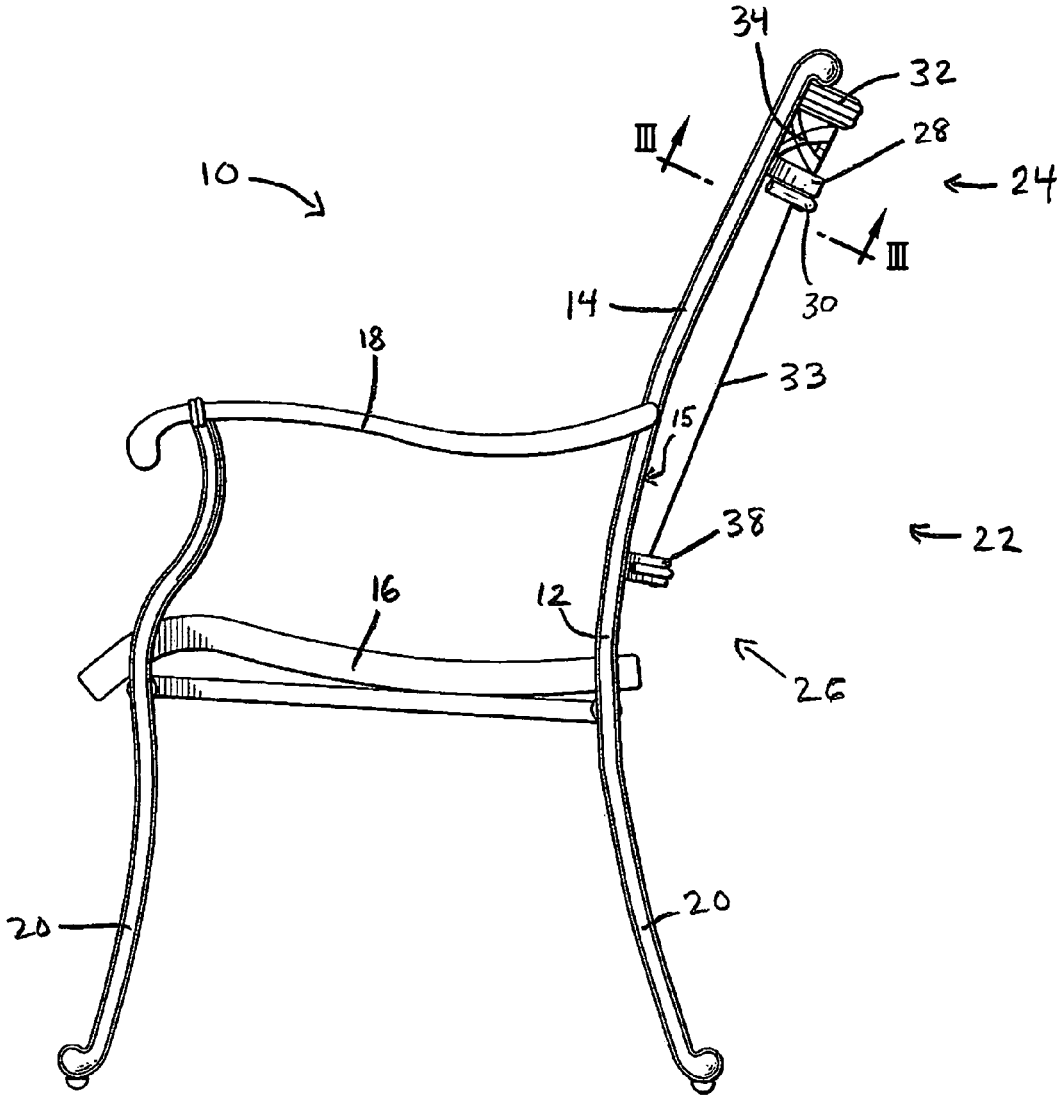
FIG. 1 is a right side view of an exemplary chair showing one embodiment of the present invention.
Figure 2:
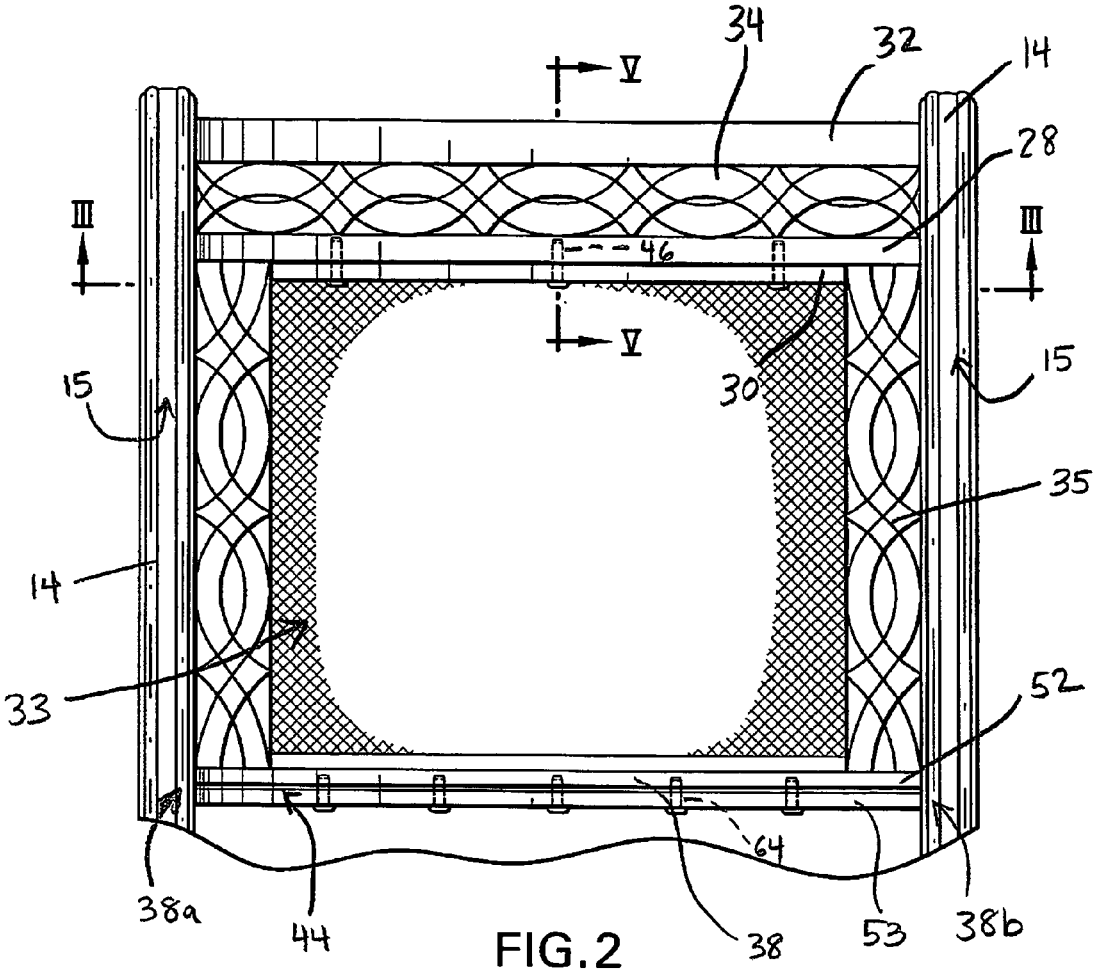
FIG. 2 is a rear elevational view of the back frame and backrest elements of the chair assembly of the present invention.

As shown in FIGS. 1 through 6, the present invention provides a single frame sling chair 10, having a rigid frame 12. FIG. 1 shows an overall, right side view of one embodiment of a chair according to the present invention, including monolithic welded frame 12 comprising frame rails 14, seat 16, armrests 18 and leg portions 20. A backrest assembly 22 is also shown, including upper backrest assembly portion 24 and lower backrest assembly portion 26. Upper backrest assembly portion 22 includes top cross bar 28 and detachable support bar 30, described more completely hereafter. Top cross bar 28 may be integrally formed with top element 32 and connective fascia 34, or may be secured to elements 32 and 34 as separate members. Top cross bar is secured to, and acts as a spreader between, frame side rails 14, as shown in FIG. 2.

As further shown in FIGS. 1 and 2, lower backrest assembly portion 26 includes bottom cross bar 38 which is secured to frame rails 14 and acts as a spreader to hold frame rails 14 apart. Bottom cross bar 38 cooperates with top cross bar 28 to hold frame rails 14 in substantially parallel relation. A backrest 33, such as a sling fabric member, is secured to the upper 24 and lower 26 backrest assembly portions to provide body support to individuals using the chair of the present invention.

In the embodiment as shown in FIG. 2, top and bottom cross bar members are provided in substantially parallel relation. The crossbars 28, 38 are provided of a curved or concave shape generally, and can be solid or hollow. As shown in FIGS. 1 and 2, the crossbars 28, 38 project at least partially outwardly away from respective back faces 15 of side rails 14. The crossbars 28, 38 can be any of a variety of section shapes, and can be adapted to accept a decorative casting 34 as part of or an attachment to crossbar, as shown in the exemplary embodiment of FIG. 2. Decorative side castings 35 can also be provided as shown in FIG. 2 so as to flank sling member 33. The sectional shape of side rails 14 as well as that of support bar 30 can be circular, oval, square, or other shape, for example. Further, support bar 30 and side rails 14 can be solid or hollow.

The remainder of the chair frame can have any arrangement for a seat bottom, it may have arms or no arms, and it may have any number of legs, or a pedestal instead of legs, and may be a rocker, swivel chair, swivel-rocker, swivel-glider, or a rigid monolithic frame.

Figure 3:
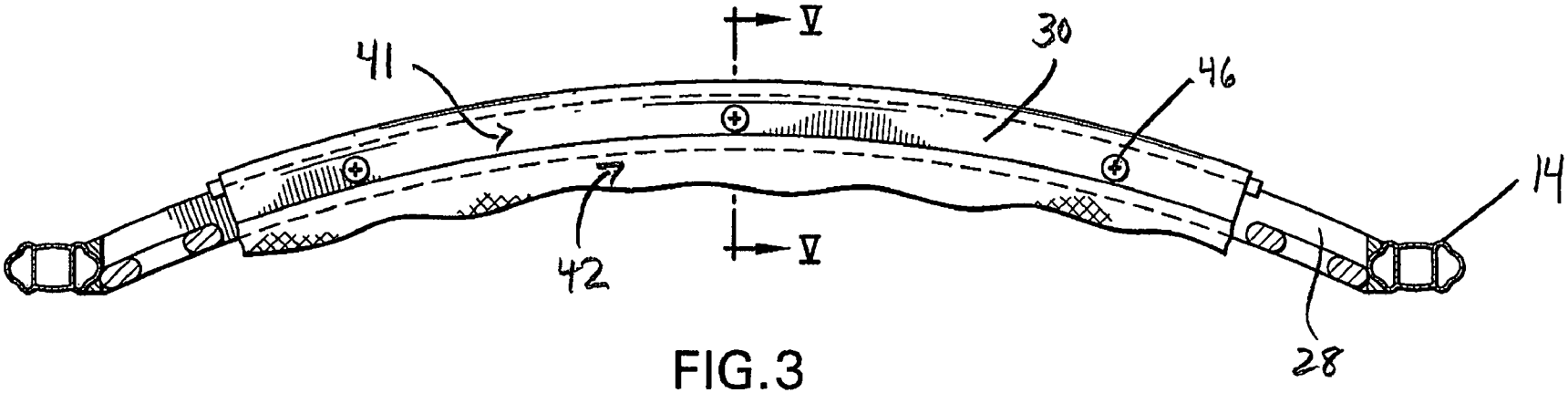
FIG. 3 is a bottom cross-sectional view of the upper backrest assembly of one embodiment of the present invention, taken along the line III-III of FIGS. 1 and 2.
Figure 5:
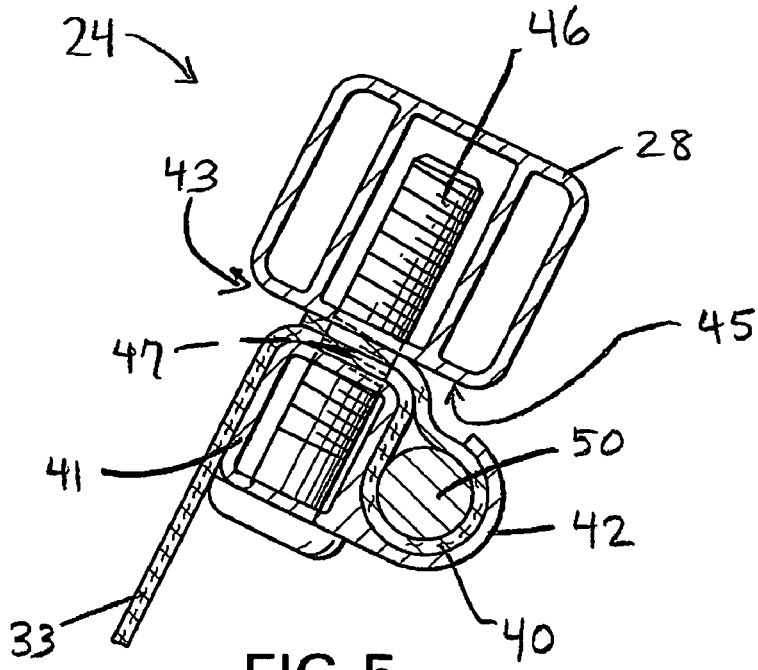
FIG. 5 is a right side cross-sectional view of the upper backrest assembly portion of one embodiment of the present invention, taken along the line V-V of FIGS. 2 and 3.

The method of securing top 28 and bottom 38 cross bar members to back frame rails 14 can be by conventional means, such as by welding or by providing the frame rails with open interior slots for receiving respective ends of cross bar members 28, 38 (not shown). The method of securing backrest 33 to top and bottom cross members involves upper 24 and lower 26 backrest assemblies. Upper backrest assembly 24 comprises at least top cross bar member 28 and detachable support bar 30. As shown in FIGS. 2, 3 and 5, detachable support bar 30 is provided with a base portion 41 and a scaffold portion 42, wherein scaffold portion can be "c"-shaped as shown for receiving a substantially rigid rod 50. As shown in FIG. 5, rod member 50 is placed through a loop 40 in sling member 33, wherein the sling loop 40 and rod 50 rest in the channel created by scaffold portion 42. Loop 40 can be formed, for example, by bending sling member edge back upon itself and securing the sling member to itself, such as via a hem or similar method. A portion of sling member 33 thus rests in the gap 43 created by the base portion 41 and cross bar member 28. The support bar 30 can be secured to the bottom face 45 of top cross bar 28 using screws 46 mating with internal threads 47 in base portion 41 and cross bar 28, for example. Alternative means of fastening support bar 30 to top cross bar 28 can be employed, such as sheet metal screws, hook and loop fasteners, clamps, or malleable plug members extending from support bar 30 into openings in cross bar 28, for example.

Figure 4:
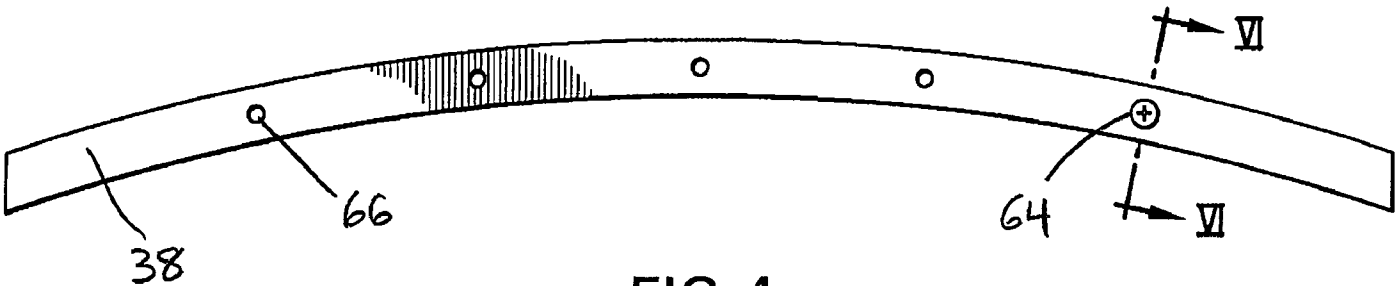
FIG. 4 is a bottom plan view of one embodiment of the bottom cross bar member of the present invention.
Figure 6:
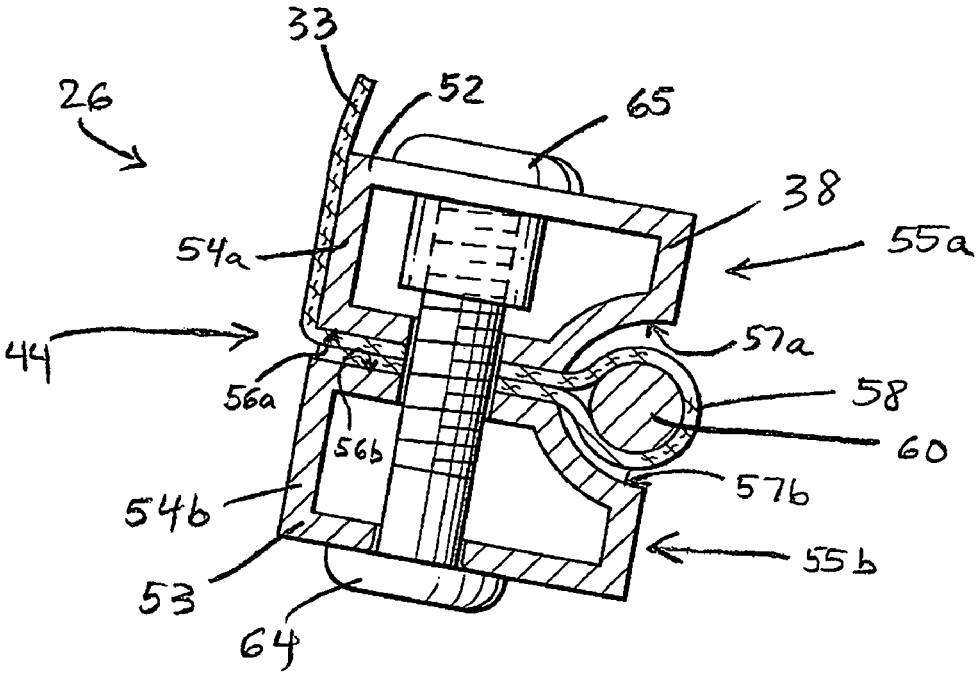
FIG. 6 is a right side cross-sectional view of the lower backrest assembly portion of one embodiment of the present invention, taken along the line VI-VI of FIG. 4.

As shown in FIGS. 2, 4 and 6, lower backrest assembly 26 comprises at least bottom cross bar 38 and rod member 60. As shown in FIGS. 2 and 6, bottom cross bar 38 can include an upper portion 52 and a lower portion 53 which join together at respective ends 38*a* and 38*b*, and which have respective inside walls 54*a* and 54*b*, outside walls 55*a* and 55*b* and interior facing walls 56*a* and 56*b*. Cross bar member 38 can be formed as a unitary, monolithic piece or can be formed by securing respective portions 52 and 53 together at ends 38*a* and 38*b* through welding or other attachment means. Regardless of how formed, the interior facing walls 56*a* and 56*b* cooperate to form a through-and-through slot 44. As shown in FIG. 2, slot 44 can extend for substantially the length of upper 52 and lower 53 portions. As shown in FIG. 6, the end of fabric sling 33 opposite the end secured to upper bracket assembly is provided with a loop 58 for receiving rod member 60. Loop 58 can be formed in a manner similar to that described for forming loop 40. Rod member and sling loop portion 58 are then retained against outside walls 55*a* and 55*b*, which are respectively provided with inwardly extending portions 57*a* and 57*b* for such purpose. In one embodiment as shown in FIG. 6, inwardly extending portions 57*a* and 57*b* are arcuate in cross-section. Portions 57*a* and 57*b* assist in providing the back assembly 22 with a low profile, minimizing the extent of rod and sling extension outside of the plane formed by outside walls 55*a* and 55*b*, which in turn minimizes sling member exposure to unnecessary wear and tear. As shown in FIGS. 4 and 6, the securing of sling member 33 within lower bracket assembly 26 can be optionally enhanced through the employment of one or more machine screws 64 extending through openings 66 in lower cross bar member and mated with hollow receiving screw 65 or other similar securing element. In one embodiment of the invention, a screw receiving member such as a nut having an interior threaded surface is maintained within walls of cross bar 38 so as to receive screw 64 while not extending outwardly of the upper portion 52 of cross bar 38. In this way, minimum visibility of attachment elements such as nuts and bolts can be maintained, which enhances the aesthetic qualities of the present invention.

It will be appreciated that the shape of top 28 and bottom 38 cross bar members can be adapted to suit particular chair requirements in accordance with the present invention. For example, the top cross bar member 28 can have a rounded rectangle cross-sectional shape, as shown in FIG. 5, or can have a square, hexagonal, octagonal or other polygonal shape. Bottom cross bar member 38 can have a primarily rectangular shape with arcuate interior wall segments 57*a* and 57*b* as shown in FIG. 6 and described earlier. Alternatively, bottom cross bar member 38 can have a square, hexagonal, octagonal or other polygonal shape. In one embodiment, bottom cross bar member 38 has an octagonal shape and adjacent edges establish a receiving channel for retaining rod member 58 and looped hem 60, again minimizing the outward extension of the sling fabric loop and rod member beyond the lower backrest assembly. In a further embodiment, a metal frame member (not shown) can be secured to upper 52 and lower 53 portions of bottom cross bar member 38 to conceal and protect sling member 33 and loop 60.

By placing the sling entrapment at the top and bottom in the cross members, rather than in the side rails, the invention facilitates the creation of a comfortable concave shape to the back rest. Also, the invention thereby allows for shorter looped hems and dowels than would exist if the sling were attached to the side rails. The invention also permits sturdier and more rigid frame construction and leaves open more design possibilities for accessory items.

The method of assembling the backrest 22 to the frame 12 according to the present invention can occur in several ways. In one exemplary way, chair frame 12 is provided with top cross bar member 28 and bottom cross bar member 38 secured to side rails 14 as shown in FIG. 2. Sling member 33 is provided with looped hems 40 and 58 at two ends thereof. Looped end 58 is manipulated through slot 44 in lower cross bar member so as to be positioned somewhat adjacent to wall portions 57*a* and 57*b*. Rod member 60 is then manipulated through looped end 58 such that any tension applied to the remainder of sling member, such as pulling on sling member from a location on the interior of lower cross bar member, will result in looped hem 58 contacting wall portions 57*a* and 57*b*. Machine screws and nuts or equivalent attachment means can assist in retaining sling member in place with respect to bottom cross bar member 38.

Next, rod member 50 is placed through looped hem portion 40 of sling member 33, and this arrangement is positioned over base portion 41 of support bar 30 and within scaffold portion 42. Support bar 30 is then raised so as to align with the under face 45 of top cross bar member 28. Threaded bolts 46 or similar attachment means can then be manipulated through base portion 41, sling member 33 and top cross bar member 28 to securely maintain support bar and sling to top cross bar member 28.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

The invention claimed is:

1. A sling chair, comprising:

a back frame member having a pair of side rail members, said back frame member further having first and second cross bar members secured to each of said side rail members so as to maintain said side rail members in substantially parallel relation, said second cross bar member having an upper and a lower portion, said upper and lower portions having interior faces which define a slot extending between said upper and lower portions and through said second cross bar member;

a sling assembly detachably secured to said back frame member, said sling assembly comprising a support bar member detachably securable to said first cross bar member, said support bar member having an upper surface and being secured to said first cross bar member such that said support bar upper surface and said first cross bar member create a gap between the first cross bar member and the support bar member extending from an inside surface of each all the way through to an outside surface of each, said sling assembly further comprising a sling member having a top and a bottom edge, each of said edges having a loop formed therein, said sling assembly further including a pair of elongated rods, whereby a first of said sling member edges can be positioned through said slot and a second of said sling member edges can be positioned through said gap and whereby a respective one of said rods can be inserted through a respective loop such that said sling member is securely retained; and wherein the support bar member is detachably securable to said first cross bar member by fasteners that mate with internal threads located within the first cross bar member.

2. The chair of claim 1 wherein each of the pair of side rail members has a front and a back face, and further wherein said first and second cross bar members are substantially parallel to one another and are generally concave in shape so as to project at least partially outwardly away from said respective back faces of said side rail members.

3. The chair of claim 1 further comprising a seat member secured to said back frame member.

4. The chair of claim 1 wherein said support bar includes a base portion and a scaffold portion, and wherein a first one of said rods is inserted through its respective sling member loop so as to be retained within said scaffold portion.

5. The chair of claim 4 wherein said scaffold portion is substantially c-shaped in cross section.

6. The chair of claim 4 wherein said support bar is secured to said first cross bar member at one or more points along the support bar base portion.

7. A back frame assembly for a sling chair, comprising:

a first cross bar member having a lower surface and a generally curved shape;

a second cross bar member having a generally curved shape and having an upper and a lower portion, said upper and lower portions having interior faces which define a slot extending between said upper and lower portions and through said second cross bar member;

a support bar member detachably secured to said first cross bar member, said support bar member having an upper surface and being secured such that a gap is created between the support bar member's upper surface and the lower surface of said first cross bar member, the gap extending from an inside surface of each all the way through to an outside surface of each;

a sling member having a top and a bottom edge;

means for securing said top edge of said sling member between said first cross bar and said support bar member;

means for securing said bottom edge of said sling member to said second cross bar member;

wherein said sling member top and bottom edges are each bent back and secured so as to form a loop, the sling member top edge can be positioned through said gap, the sling member bottom edge can be positioned through said slot, wherein said top edge securing means includes a first rod positioned within said top edge loop, and wherein said bottom edge securing means includes a second rod positioned within said bottom edge loop; and wherein the support bar member is detachably securable to said first cross bar member by fasteners that mate with internal threads located within the first cross bar member.

8. The back frame assembly of claim 7 wherein said top edge securing means includes providing said support bar member with a scaffold portion for receiving said first rod.

* * * * *